US006939201B2

(12) United States Patent
Kawashita

(10) Patent No.: US 6,939,201 B2
(45) Date of Patent: Sep. 6, 2005

(54) GRINDING TOOL, AND METHOD AND APPARATUS FOR INSPECTION CONDITIONS OF GRINDING SURFACE OF THE SAME

(75) Inventor: Tomoyuki Kawashita, Sasebo (JP)

(73) Assignee: President of Sasebo National College of Technology, Sasebo (JP)

( * ) Notice: Subject to any disclaimer, the term of this patent is extended or adjusted under 35 U.S.C. 154(b) by 0 days.

(21) Appl. No.: 10/614,810

(22) Filed: Jul. 9, 2003

(65) Prior Publication Data

US 2004/0009736 A1 Jan. 15, 2004

(30) Foreign Application Priority Data

Jul. 9, 2002 (JP) ..... 2002-199941

(51) Int. Cl.[7] ..... B24B 49/00

(52) U.S. Cl. ..... 451/8; 451/5; 451/541

(58) Field of Search ..... 451/8, 5, 57, 59, 451/548, 541; 382/106, 141, 252

(56) References Cited

U.S. PATENT DOCUMENTS 5,736,427 A * 4/1998 Henderson ..... 438/14
6,136,043 A * 10/2000 Robinson et al. ..... 8/485
6,736,702 B2 * 5/2004 Minami ..... 451/8

FOREIGN PATENT DOCUMENTS

JP 62-29256 * 2/1987
JP 7-218416 * 8/1995

* cited by examiner

*Primary Examiner*—Dung Van Nguyen
(74) *Attorney, Agent, or Firm*—Oblon, Spivak, McClelland, Maier & Neustadt, P.C.

(57) ABSTRACT

The grindstone is configured so that at least the surface of each abrasive grain is colored differently from the surface of a base.

20 Claims, 9 Drawing Sheets

GRINDING TOOL, AND METHOD AND APPARATUS FOR INSPECTION CONDITIONS OF GRINDING SURFACE OF THE SAME

CROSS-REFERENCE TO RELATED APPLICATIONS

This application is based upon and claims the benefit of priority from the prior Japanese Patent Application No. 2002-199941, filed Jul. 9, 2002, the entire contents of which are incorporated herein by reference.

BACKGROUND OF THE INVENTION

1. Field of the Invention

The present invention relates to a grinding tool that uses a surface of a tool base on which abrasive grains are discretely provided, as a grinding surface, as well as a method and apparatus for picking up an image of the grinding surface of this grinding tool to inspect the conditions of the grinding surface on the basis of the image data obtained.

2. Description of the Related Art

In the field of grinding work, a non-porous grindstone or a porous grindstone is commonly used as a grinding tool. The non-porous grindstone has a grinding surface formed by using a binder 13 to stick abrasive grains 20 to a peripheral surface of a grindstone base 11, for example, as shown in FIG. 11. If such a grindstone 10 is used for grinding work, the grindstone 10, which is shaped like a disk or a cylinder, is rotated at a high speed in the direction of an arrow A, for example, as shown in FIG. 12. Then, a grinding surface of the grindstone 10 is abutted against a surface of workpiece 30 to be ground. Then, the workpiece 30 is moved at a constant speed in the direction of an arrow B. Thus, the ground surface of the workpiece 30 is cut to a fixed depth D by the abrasive grains 20. The surface of the workpiece 30 is thus ground. Reference numeral 31 denotes chips resulting from the cutting by the abrasive grains 20.

In grinding work of this kind, the finishing quality of the ground surface of the workpiece 30 depends on the condition of the grinding surface of the grindstone 10. The conditions of the grinding surface are primarily determined by the shape and size of the surface of each abrasive grain 20, functioning as a cutting edge, the distribution of the abrasive grains 20, and the amount of projection of each abrasive grain 20. Thus, large grinding streaks may remain on the ground surface of the workpiece depending on the conditions of the abrasive grains 20. FIG. 13 is a partial enlarged view showing an example of grinding streaks 32. Accordingly, to achieve high-quality grinding work, it is important to accurately determine the conditions of the grinding surface, i.e. the shape and size of the surface of each abrasive grain 20, the distribution of the abrasive grains 20, the amount of projection of each abrasive grain 20, and the like.

Thus, in the prior art, an image of the grinding surface is picked up using, for example, a metallurgical microscope of a high magnification provided with a camera. Then, image data obtained is subjected to predetermined image processing to create an image in which the abrasive grains 20 appear to stand out. Subsequently, the image is inspected. Efforts have hitherto been made to study such techniques.

However, the tip of each abrasive grain 20, which functions as a cutting edge, has a color density similar to that of the binder 13 covering the surface of the base 11. Thus, in the image data obtained, it is very difficult to use a difference in color density to make the tips of the abrasive grains 20 more conspicuous than the other parts such as the binder. Further, the tip of each abrasive grain 20 does not have a distinctive shape. It is thus also difficult to display the tips of the abrasive grains 20 so as to distinguish the tips from the other parts on the basis of their shapes. On the other hand, it has been contemplated that this problem may be solved by applying recent advanced image processing techniques. However, this method requires complicated image processing and a high-definition camera. This in turn requires an expensive large-scale system. Therefore, this method is not practical.

Furthermore, even if such a system is used to successfully display the abrasive grains 20, it is impossible to extract those of the abrasive grains 20 forming the grinding surface which are actually involved in the grinding work. It is thus difficult to determine the condition of the abrasive grains actually involved in the grinding work.

BRIEF SUMMARY OF THE INVENTION

It is an object of the present invention to provide a grinding tool that enables the condition of the grinding surface of the grinding tool to be accurately inspected without using complicated image processing techniques, as well as a method and apparatus for inspection the conditions of the grinding surface.

In order to achieve the above object, according to an aspect of the present invention, a grindstone is configured so that at least the surface of each abrasive grain is colored differently from the surface of a base.

Additional objects and advantages of the invention will be set forth in the description which follows, and in part will be obvious from the description, or may be learned by practice of the invention. The objects and advantages of the invention may be realized and obtained by means of the instrumentalities and combinations particularly pointed out hereinafter.

BRIEF DESCRIPTION OF THE SEVERAL VIEWS OF THE DRAWING

The file of this patent contains at least one photograph executed in color. Copies of this patent with color photographs will be provided by the Patent and Trademark Office upon request and payment of the necessary fee.

The accompanying drawings, which are incorporated in and constitute a part of the specification, illustrate presently preferred embodiments of the invention, and together with the general description given above and the detailed description of the embodiments given below, serve to explain the principles of the invention.

DETAILED DESCRIPTION OF THE INVENTION

Figure 1:
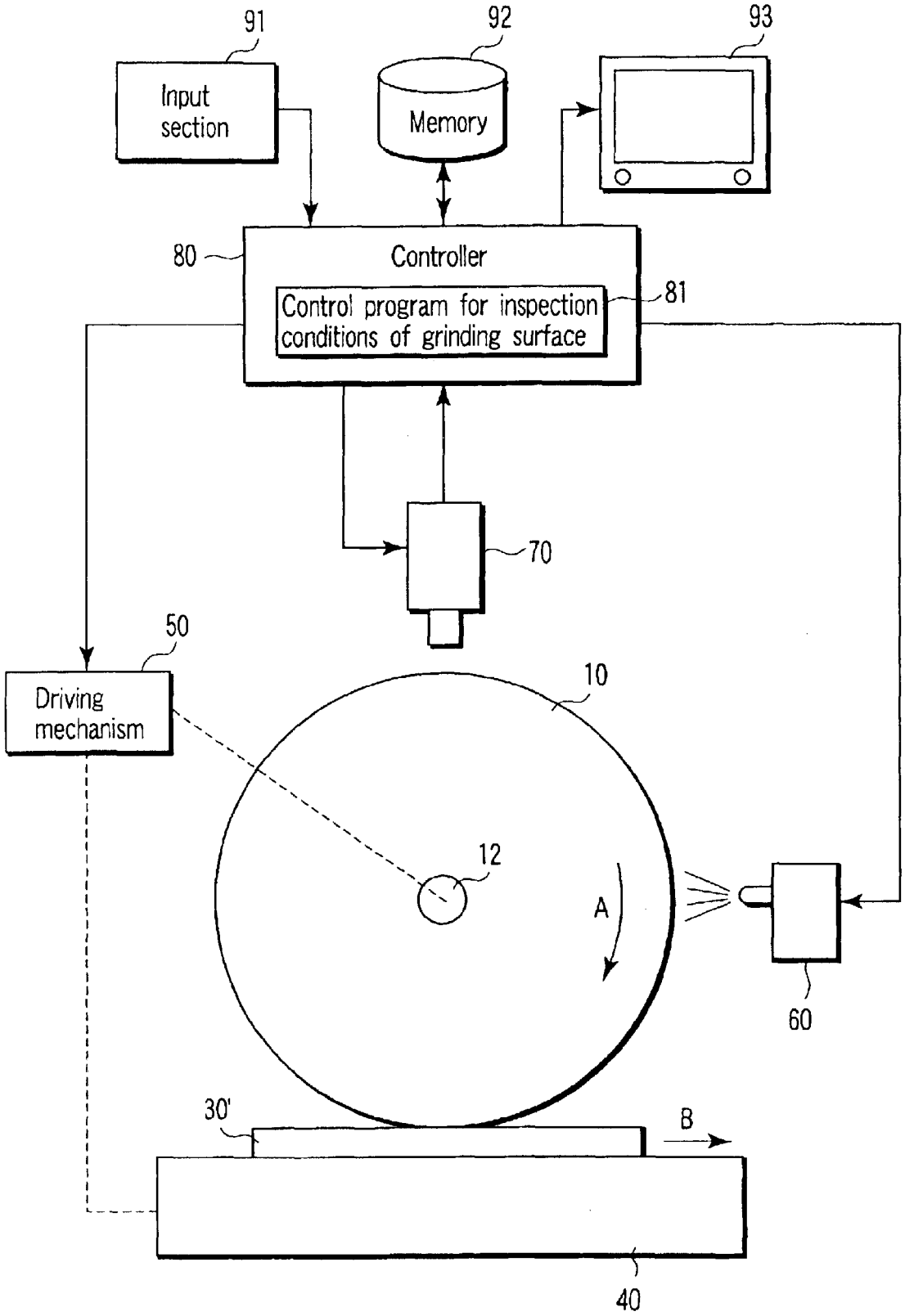
FIG. 1 is a schematic view showing a configuration of an inspection system used to implement a grinding surface condition inspection method according to a first embodiment of the present invention.

First, description will be given of a grinding tool and a grinding condition inspection method according to an embodiment of the present invention.

The grindstone is configured so that at least the surface of each abrasive grain is colored differently from the surface of a base. Accordingly, when an image of a grinding surface of the grinding tool is picked up to inspect the conditions of the grinding surface, on the basis of the image data obtained, the grinding surface is displayed so that the surface of each abrasive grain can be clearly distinguished from the base. It is thus possible to accurately inspect elements indicating the condition of the grinding surface, e.g. the distribution density of the abrasive grains and the shape and size of the surface of each abrasive grain.

To color the surface of each abrasive grain differently from the surface of the base, a coloring agent may be applied to at least either the surface of base or the surface of each abrasive grain. Alternatively, either the base or the abrasive grain may be mixed with a coloring additive before being molded. With the former means, a coloring operation can be performed after the grinding tool has been produced or can be preformed on an existing grinding tool. On the other hand, with the latter means, a colored state can be advantageously maintained even if the grinding surface is worn after the use of the grinding stone has been started.

Further, the color of the surface of each abrasive grain may be set to have a density differing from that of the color of the surface of the base by a predetermined or larger amount or to be complementary to the color of the surface of the base. Then, even if the image data obtained by picking up an image of the grinding surface is a monochrome image, it can be displayed so that data on the surface of each abrasive grain can be clearly distinguished from data on the surface of the base.

On the other hand, with the method and apparatus for inspection the conditions of a grinding surface according to the embodiment of the present invention, in inspection the conditions of a grinding surface comprising a surface of a base on which abrasive grains are formed, a color difference is first set between the surface of the base and the surface of each abrasive grain. Then, image data is obtained by picking up an image of the grinding surface for which the color difference has been set. Then, this image data is subjected to image processing on the basis of the color difference. Subsequently, the processed image data is outputted. This image processing emphasizes the difference between the data indicating the surface of each abrasive grain and the data indicating the surface of the base.

Accordingly, before an image of the grinding surface is picked up, a predetermined color difference is set between the surface of the base and the surface of each abrasive grain on the grinding surface. Thus, in the image data obtained by picking up an image of the grinding surface, it is possible to execute simple image processing to emphasize the difference between the data indicating the surface of each abrasive grain and the data indicating the surface of the base. Therefore, the conditions of the grinding surface can be more accurately inspected.

Further, on the basis of the processed image data, numeric data is calculated which represents at least one of the distribution density of the abrasive grains and the shape and size of the surface of the abrasive grain. It is then possible to obtain accurate inspection results that do not vary according to the inspector, compared to the visual inspection of the processed image data for the condition of the grinding surface.

Furthermore, the calculated numerical data may be compared with a preset threshold to output the result of the comparison. Then, even an inexperienced inspector can easily determine whether or not the grindstone has a predetermined quality.

The plurality of methods described below may be used to set a color difference between the surface of the base and the surface of each abrasive grain.

A first method comprises applying a coloring agent to the grinding surface which has a color different from that of the surface of each abrasive grain, and then removing only those portions of the coloring agent applied to the grinding surface which are located on the surfaces of the abrasive grains, against which a workpiece is abutted. This method enables a color difference to be relatively easily set without complicated coloring operations or special coloring agents.

Further, the step of removing the coloring agent from the surfaces of the abrasive grains may comprise abutting the grinding surface against a false workpiece. When the grinding surface is grounded by being actually abutted against the workpiece, the coloring agent can be removed only from the surfaces of the abrasive grains actually involved in grinding work. It is thus possible to accurately determine the distribution, shape, size, and the like of the abrasive grains actually involved in grinding work.

A second method comprises applying a coloring agent of a first color to the grinding surface and then causes the coloring agent on the surfaces of the abrasive grains to develop a second color, the abrasive grains being provided on the grinding surface, to which the coloring agent has been applied. This method enables a color difference to be set without actually using the grinding tool. Therefore, the second method is applicable to the inspection of a new grinding tool.

Further, the process of causing the coloring agent on the surfaces of the abrasive grains to develop the second color can be implemented by applying a coloring agent to the grinding surface which develops a different color under heat and then abutting the grinding surface against a false workpiece composed of a heating element. This enables a color change to occur only in the coloring agent located on the surfaces of the abrasive grains actually involved in grinding work. It is thus possible to accurately determine the distribution, shape, size, and the like of the abrasive grains actually involved in grinding work.

The color difference may be set so that there is a predetermined or larger difference in density between the surface of each abrasive grain and the surface of the base in the image data obtained by the camera. To achieve this, it is possible that, for example, the surface of each abrasive grain and the surface of the base have complementary colors. Then, even if the image data obtained by picking up an image of the grinding surface is a monochrome image, it can be displayed so that data on the surface of each abrasive grain can be clearly distinguished from data on the surface of the base.

Subsequently, description will be given of more specific embodiments of a grinding tool and an inspection method according to the present invention.

First Embodiment

FIG. 1 is a view showing a configuration of an inspection system used to implement a grinding surface condition inspection method according to a first embodiment of the present invention.

A non-porous grindstone (hereinafter referred to as a "grindstone") 10 comprises a tool base 11 shaped like a disk or a cylinder and having abrasive grains 20 stuck to its peripheral surface using a binder 13 as shown in FIG. 7. A grinding surface comprises a surface of the base to which the abrasive grains are stuck. The grindstone 10 is mounted over a rotating shaft 12 and is rotatively driven in the direction of an arrow A by a driving mechanism 50.

Further, a work-table 40 is arranged below the grind stone 10. The work-table 40 is driven by the driving mechanism 50 to move a false workpiece 30' at a constant speed in the direction of an arrow B. The false workpiece 30' is composed of a material which is softer than the grinding surface of the grindstone 10 and to which a coloring agent, described later, adheres easily.

A spray 60 and a microscope 70 with a camera are disposed around the periphery of the grindstone 10 and opposite the grinding surface. The spray 60 operates in response to a driving instruction from a controller 80, described later. The spray 60 then injects a coloring agent against the grinding surface of the grindstone 10. The coloring agent is selected to adhere properly to the grinding surface of the grindstone 10 and to peel off easily from the surfaces of the abrasive grains 20 when coming into contact with the false workpiece 30'. The color of the coloring agent is selected to have, in the image data obtained by the microscope 70 with the camera, described later, a density differing from that of the color of the surface of each abrasive grain 20 on the grindstone 10, i.e. the color of the surface of the cutting edge, by a predetermined or larger amount.

The microscope 70 with the camera comprises a metallurgical microscope of a high magnification and a digital camera installed in the microscope. The microscope 70 with the camera operates in response to a driving instruction from the controller 80. It then picks up an image of the grinding surface of the grindstone 10 with a predetermined magnification. It outputs the image data to the controller 80. The microscope 70 with the camera is provided with a focusing mechanism. The focusing mechanism adjusts a focus in accordance with a focus control signal outputted by the controller 80.

The controller 80 constitutes a control unit together with an input section 91, a memory 92, and a display 93. The controller 80 comprises a micro-computer as a main controller. A program memory in the microcomputer stores a control program 81 for inspection the condition of the grinding surface, in order to realize control functions relating to the present invention. The control program 81 for inspection the condition of the grinding surface is activated in response to an inspection start instruction given by the input section 91. The program 81 then controls the inspection of the conditions of the grinding surface in accordance with a predetermined procedure.

Figure 2:
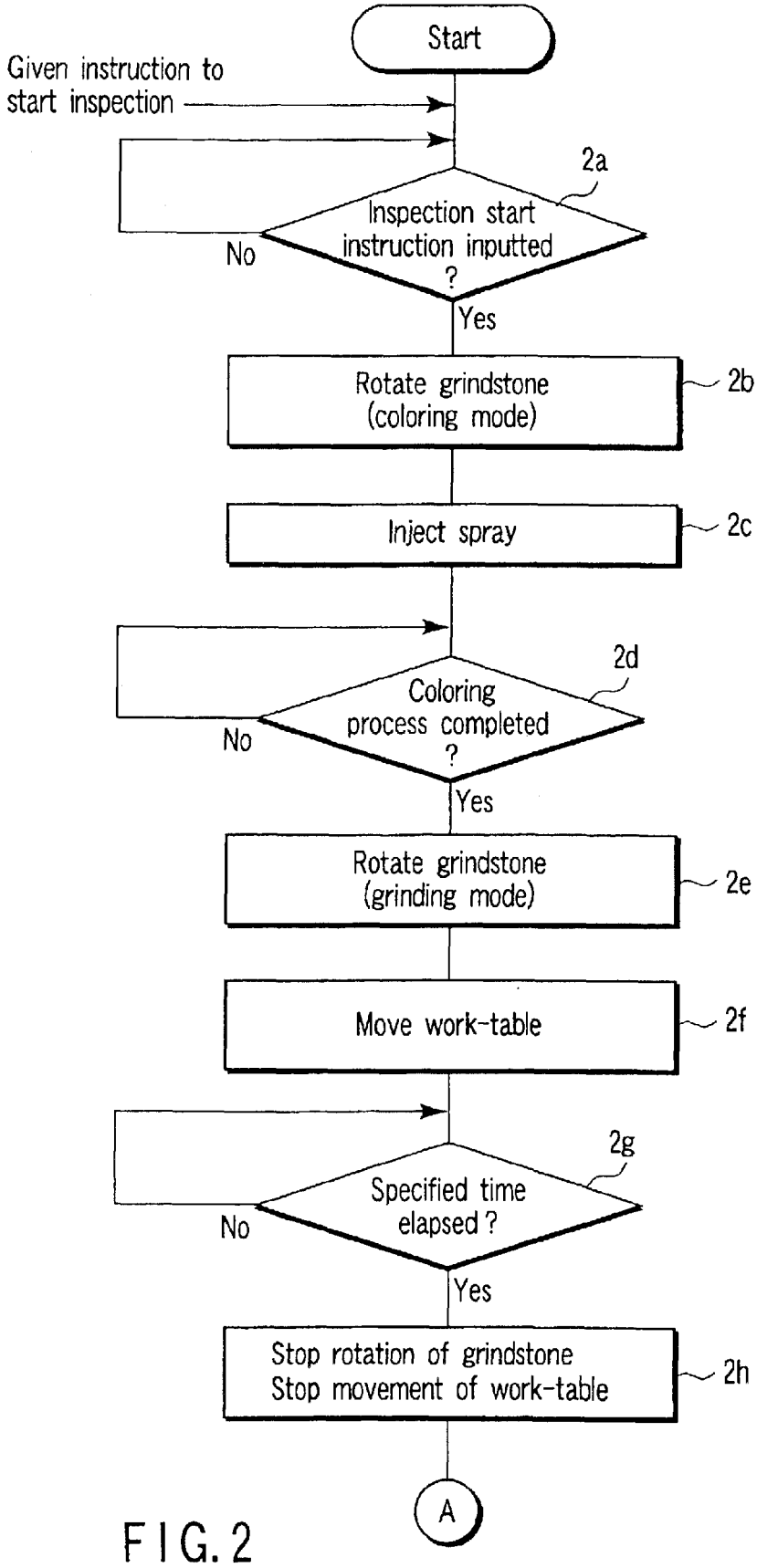
FIG. 2 is a flow chart showing the former half of an inspection control procedure executed by a controller of the inspection system shown in FIG. 1 as well of the contents of the control.
Figure 3:
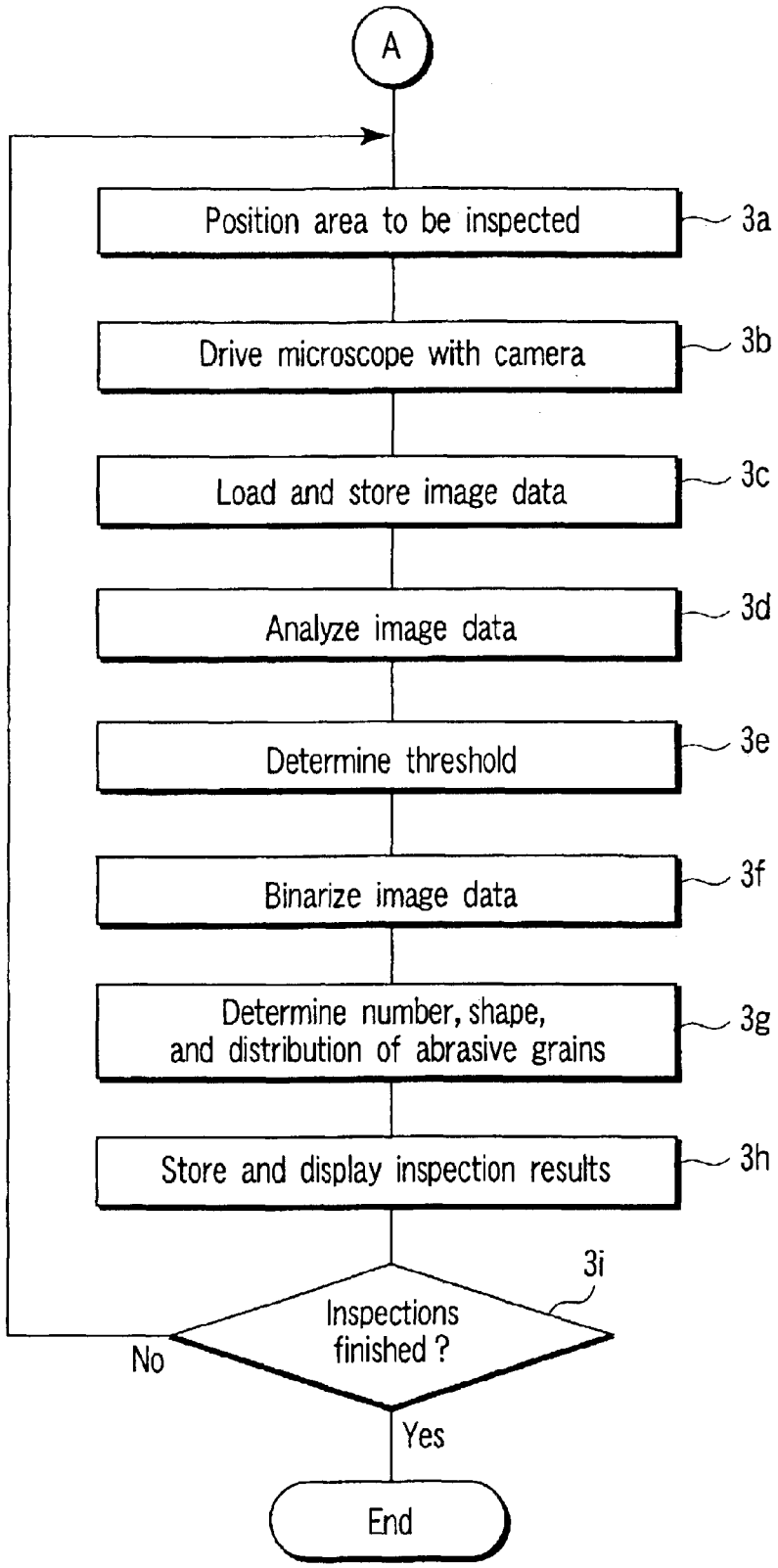
FIG. 3 is a flow chart showing the latter half of the inspection control procedure executed by the controller of the inspection system shown in FIG. 1 as well of the contents of the control.

Next, description will be given of a grinding surface condition inspection method using the inspection system configured as described above. FIGS. 2 and 3 are flow charts showing a control procedure executed by the controller 80 as well as the contents of the control.

Before inspection, the grindstone 10 to be inspected is installed over the rotating shaft 12. Further, the false workpiece 30' is set on the work-table 40. Then, after this setting operation, the operator inputs an inspection start instruction from the input section 91.

The controller 80 starts to monitor an input of an inspection start instruction at step 2*a* in FIG. 2. Then, in this state, on detecting an inputted inspection start instruction, the controller 80 first gives, at step 2*b*, a coloring mode driving instruction to the driving mechanism 50 to rotate the grindstone 10. In this case, a rotation speed is set at a relatively small value so that a coloring agent is uniformly applied to the grinding surface of the grindstone 10.

Subsequently, the controller 80 gives a driving instruction to the spray 60 to cause it to inject a coloring agent. As a result, the coloring agent is applied to the grinding surface of the grindstone 10. Then, once the coloring agent has been applied to the entire grinding surface of the grindstone 10, the controller 80 detects this at step 2*d*. The controller 80 then stops the spray 60 from injecting the coloring agent and stops the rotation of the grindstone 10. The grinding surface of grindstone 10 is thus colored.

Then, at step 2*e*, the controller 80 gives a grinding mode driving instruction to the driving mechanism 50 to rotate the grindstone 10. In this case, the rotation speed is set to be higher than that in the coloring mode so as to effectively remove those portions of the coloring agent applied to the grinding surface of the grindstone 10 which are located on the surfaces of the abrasive grains 20. Subsequently, at step 2*f*, the controller 80 gives an instruction to cause the driving mechanism 50 to drive the work-table 40.

Consequently, the grindstone 10 starts to grind the false workpiece 30' to remove the coloring agent on the surfaces of those of the abrasive grains formed on the grinding surface of the grindstone 10 which are actually involved in grinding work. This working process is executed for only a preset time by monitoring the elapsed time of the working at step 2*g*. This working time is set at a value necessary and sufficient to remove the coloring agent on the surfaces of all the abrasive grains 20 actually involved in the grinding work so that the coloring agent applied to the binder 13 on the grinding surface remains unchanged.

Then, once the coloring agent has been completely removed from the surfaces of the abrasive grains 20, the controller 80 stops the rotation of the grindstone 10 and the movement of the work-table 40 at step 2*h*.

A specific time may be required to completely dry and fix the coloring agent applied to the grinding surface of the grindstone 10. In this case, a standby process can be provided so that after the coloring step has been completed, the procedure shifts to a step of removing the coloring agent after the time required for fixation has elapsed.

Then, in accordance with the procedure shown in FIG. 3, an image of the grinding surface is picked up to obtain inspection results from the image data obtained. Specifically, first at step 3*a*, the controller 80 positions that area on the grinding surface of the grindstone 10 which is to be inspected so that this area falls within the image pickup range of the microscope 70 with the camera. Then at step 3*b*, the controller 80 gives a driving instruction to the microscope 70 with the camera to start an image pickup operation. In this case, the magnification and focus of the microscope 70 with the camera are preset. The magnification and focus of the microscope 70 with the camera can also be automatically adjusted to the optimum conditions by activating the automatic adjusting functions of the microscope.

Digital image data on the inspected area which has been obtained by image pickup is outputted to the controller 80. At step 3*c*, the controller 80 obtains and stores digital image data outputted by the microscope 70 with the camera, in the memory 92. Then at step 3*d*, the controller 80 subjects the stored digital image data to density analysis to determine chromaticity density. At step 3*e*, the controller 80 sets a threshold L for binarization on the basis of the determined chromaticity density.

Figure 4A:
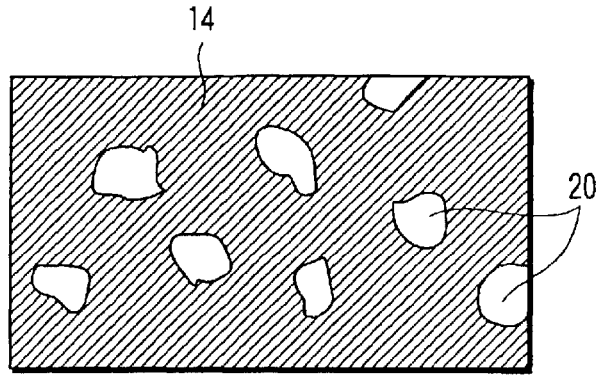
FIGS. 4A and 4B are views showing image data obtained by the inspection system shown in FIG. 1 and a histogram of the distribution of chromaticity densities in the image data.
Figure 4B:
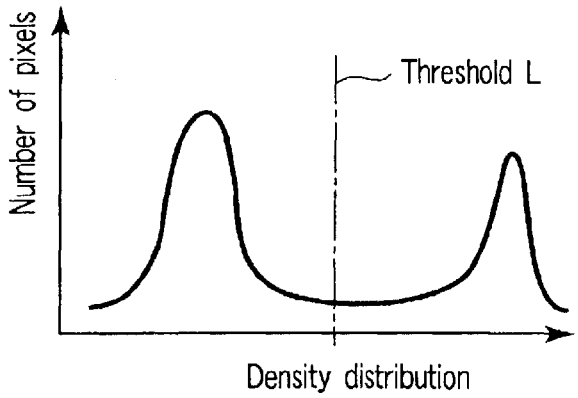

For example, it is assumed that digital image data such as that shown in FIG. 4A has been obtained. As shown in the figure, in this digital image data, there is a marked difference in chromatic density between the surface of each abrasive grain 20 and the colored binder 14 as a result of the process of coloring the grinding surface and the process of removing the coloring agent from the surfaces of the abrasive grains as described previously. Analysis of density of the chromaticity of this digital image data results in a distribution histogram with two large peaks as shown in FIG. 4B. Thus, the threshold L is set at a position halfway between the two peaks on the basis of the histogram of density distribution of chromaticity.

Then at step 3*f*, the controller 80 uses the threshold L set as described above to binarize the digital image data. This binarizing process results in a processed image from which only the images of the surfaces of the abrasive grains 20 have been extracted. Subsequently at step 3*g*, the controller 80 determines the shape and size of the surface of each abrasive grain 20 as well as the number of abrasive grains 20 per unit area (the distribution density of the abrasive grains 20). Then, the controller 80 stores numerical data indicative of the determined shape and size of the surface of each abrasive grain 20 and numerical data indicative of the determined distribution density of the abrasive grains 20. The controller 80 also causes the display 93 to display this data.

Further, in response to a command inputted by the inspector, the controller 80 compares the calculated data with corresponding preset thresholds. These thresholds are set at the minimum values of standards required for the grindstone. Then, the controller 80 causes the display 93 to display the result of the comparison as information indicating whether or not the quality of the grindstone is acceptable.

It is possible to use a printer to print out the calculated data and the information indicating the acceptability of the quality or to transmit this data to another computer or the like via a connection cable or a communication line.

Thus, an arbitrary one inspection area on the grinding surface is completely inspected. When a plurality of areas are specified as inspection areas, the inspection procedure based on the image processing described in steps 3*a* to 3*h* is repeatedly executed on each of these inspection areas. Accordingly, by specifying inspection areas on the grinding surface at the intervals of specified angles, the condition of the grinding surface can be inspected over the entire circumference of the grindstone 10.

As described above, in the first embodiment, the microscope 70 with the camera is used to pick up an image of the grinding surface of the grindstone 10 to inspect the conditions of the abrasive grains 20 on the basis of the image data obtained. In this case, the spray 60 is used to color the entire grinding surface of the grindstone 10. Then, the grindstone 10 with the colored grinding surface is used to grind the false workpiece 30' for a specified time. Thus, the coloring agent is removed from the surfaces of the abrasive grains 20 actually involved in grinding work to expose these surfaces.

Consequently, in the image data, a more marked difference in chromatic density can be made between the surface of each abrasive grain 20 and the colored binder 14. This enables the optimum binarization threshold L to be set to binarize the image data. It is thus possible to obtain a processed image from which only the images of the surfaces of the abrasive grains 20 have been precisely extracted. This in turn makes it possible to determine the shape and size of the surface of each abrasive grain 20, as well as the distribution density of the abrasive grains 20, on the basis of the binarized image.

Figure 6:
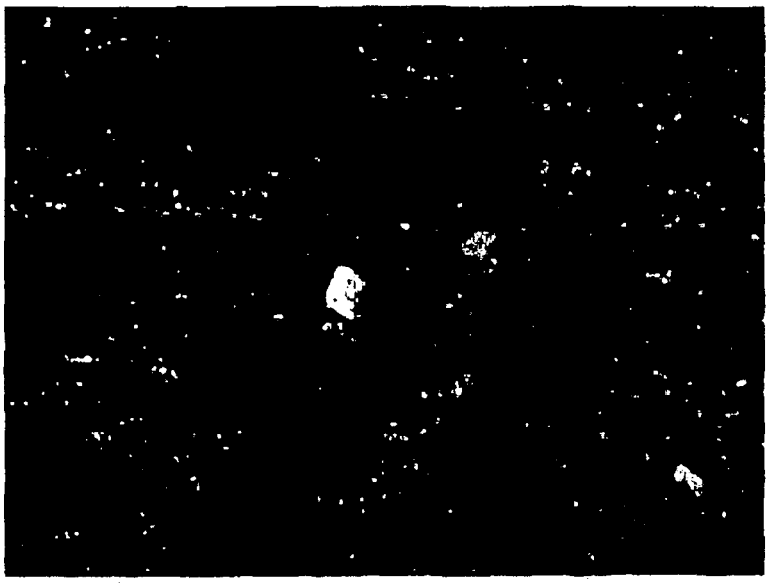
FIG. 6 is a diagram showing a grinding surface, colored red except the surfaces of grinding grains.
Figure 7A:
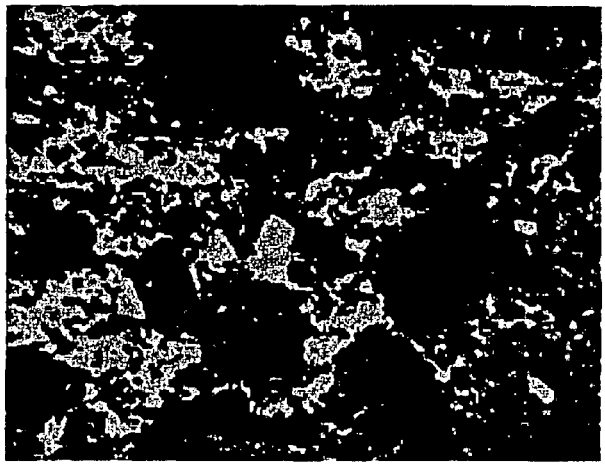
FIGS. 7A, 7B and 7C show image data generated by binarizing, using different threshold values, the image data obtained from an image of the grinding surface shown in FIG. 6.
Figure 7B:
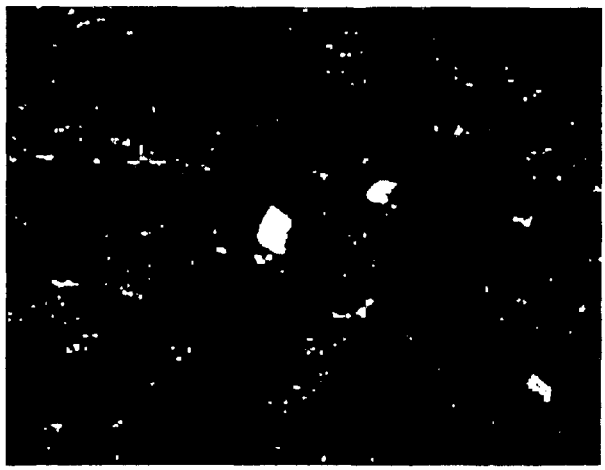

FIG. 6 shows a grinding surface, colored red except the surfaces 20 of grinding grains. FIGS. 7A and 7B show image data generated by binarizing, using two different binarization levels, the image data obtained from an image of the grinding surface shown in FIG. 6. As is apparent from these figures, by setting the binarization level at an appropriate value, the images of the abrasive grains 20 can be clearly distinguished from the surface of the base and extracted from the image data.

Figure 8:
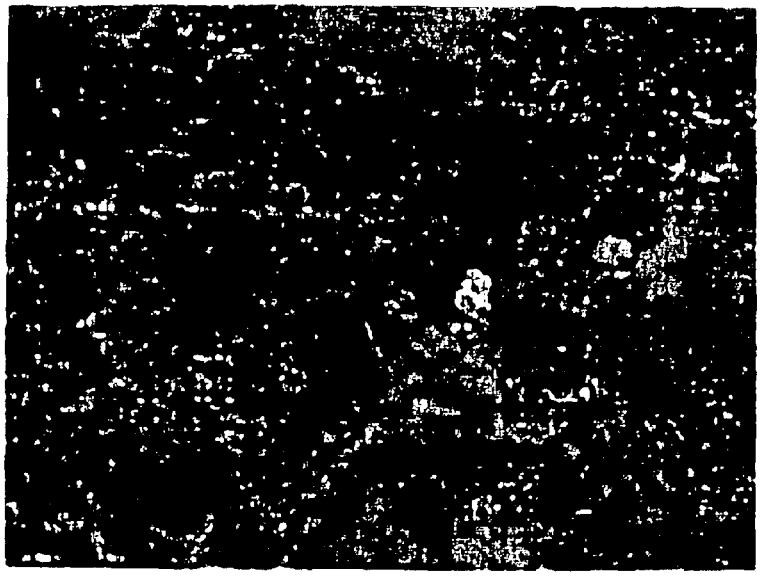
FIG. 8 is a diagram depicting a grinding surface that is not colored.
Figure 9A:
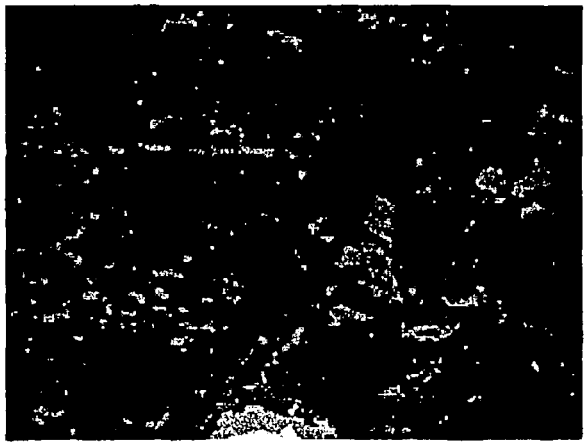
FIGS. 9A, 9B and 9C show image data generated by binarizing the image data obtained from an image of the grinding surface shown in FIG. 8.
Figure 9B:
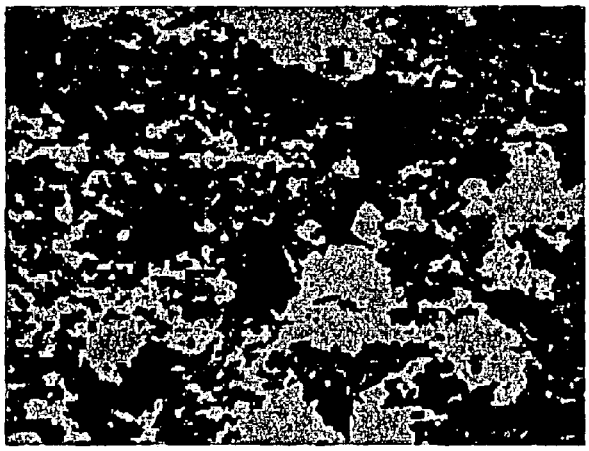
Figure 9C:
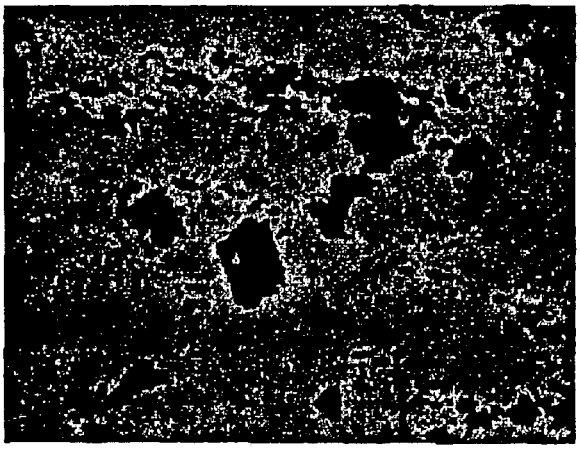
Figure 10:
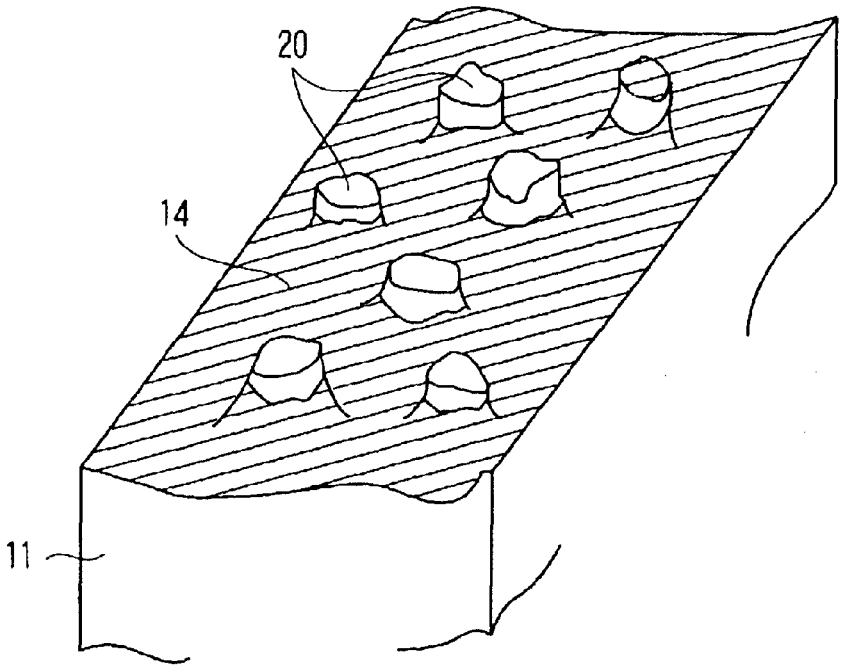
FIG. 10 is an enlarged schematic view showing a grinding surface of a grindstone according to a third embodiment of the present invention.
Figure 11:
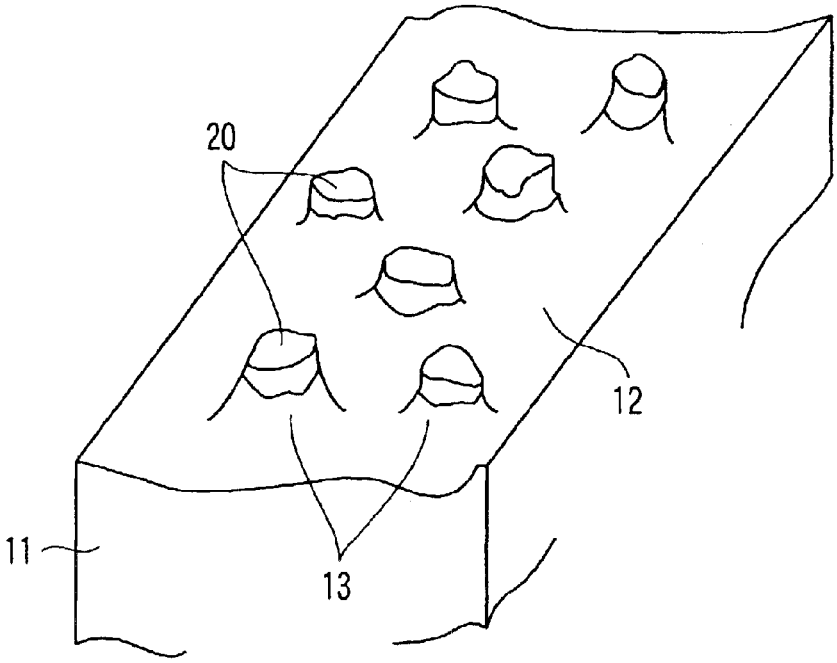
FIG. 11 is an enlarged schematic view showing a grinding surface of a conventional grindstone.
Figure 12:
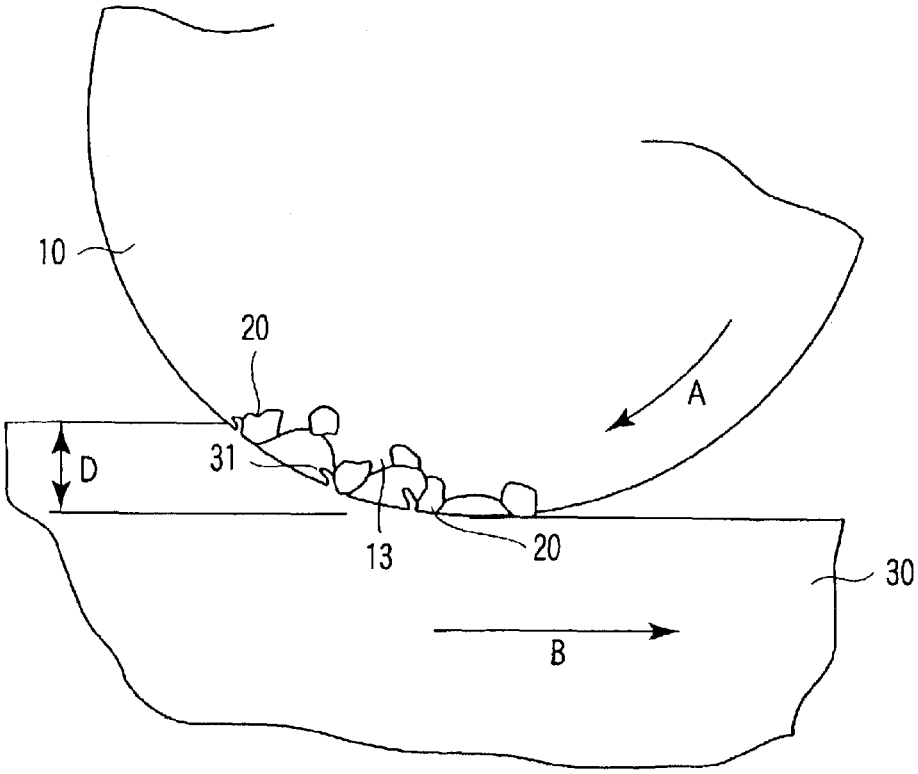
FIG. 12 is a view showing an example of grinding work that uses the grindstone shown in FIG. 11.
Figure 13:
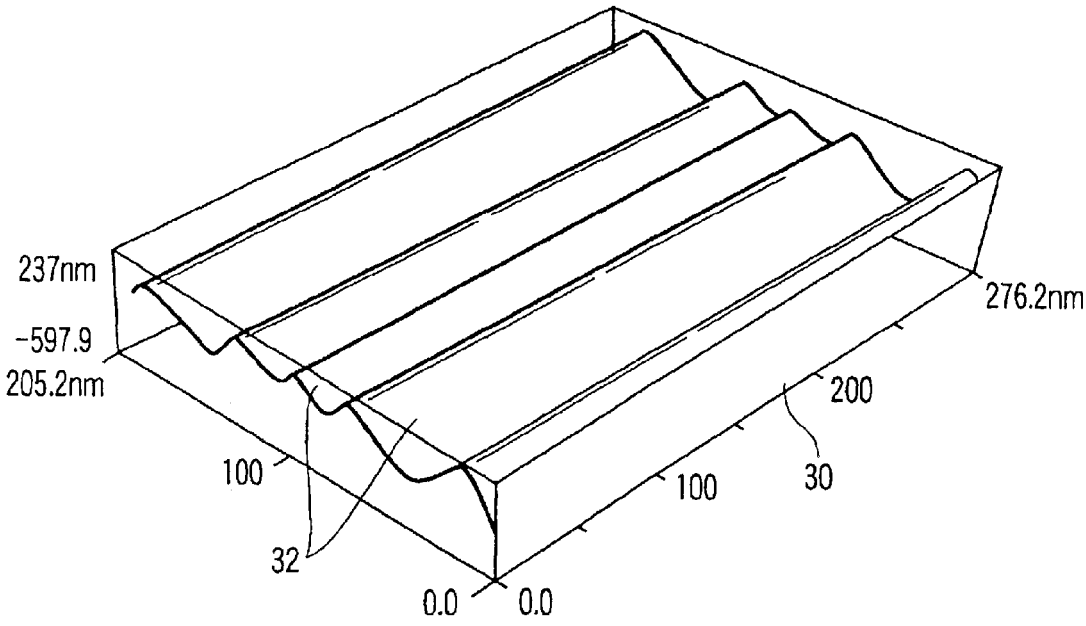
FIG. 13 is an enlarged view showing the conditions of a ground surface of a workpiece after grinding work.

FIG. 8 depicts a grinding surface that is not colored. FIGS. 9A and 9B and 9C show image data generated by binarizing, using three different binarization levels, the image data obtained from an image of the grinding surface shown in FIG. 8.

Figure 5A:
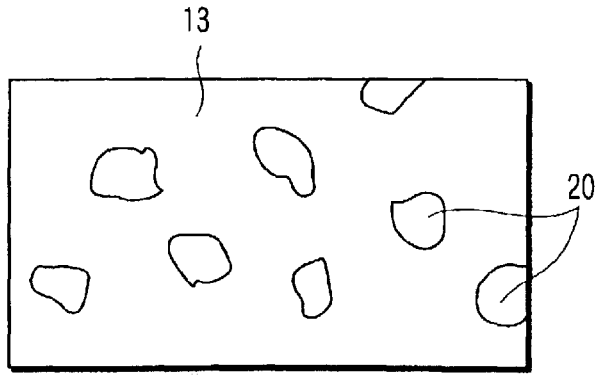
FIGS. 5A and 5B are views showing image data obtained by a conventional inspection method and a histogram of the distribution of chromaticity densities in the image data.
Figure 5B:
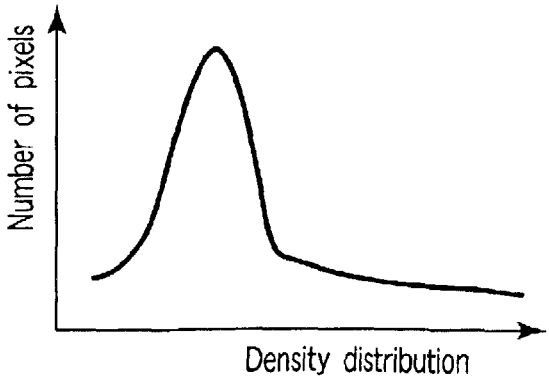

In image data obtained by picking up an image of the grinding surface without coloring it, almost no differences in chromatic density appear between the images of the abrasive grains 20 and the other images of the binder 13, for example, as shown in FIG. 5A. The histogram of the density distribution of chromaticity indicates that only one peak has been detected, as shown in FIG. 5B. It is thus difficult to accurately set the binarization threshold and to precisely determine the conditions of the abrasive grains on the binarized image data.

Furthermore, in the first embodiment, the colored grindstone 10 is used to grind the false workpiece 30' to remove the coloring agent from the surfaces of the abrasive grains 20. Consequently, the coloring agent can be removed only from the surfaces of the abrasive grains actually involved in the grinding work. It is thus possible to determine the shape and size of only the abrasive grains 20 actually involved in the grinding work as well as the distribution density of these abrasive grains 20.

Second Embodiment

In the first embodiment, the coloring agent is removed from the surfaces of the abrasive grains 20 by using the spray 60 to color the entire grinding surface of the grindstone 10 and then using the grindstone 10 with the colored grinding surface to grind the false workpiece 30' for a specified time.

In contrast, in a second embodiment of the present invention, after the entire grinding surface of the grindstone 10 has been colored using the spray 60, the coloring agent on the surfaces of the abrasive grains 20 on the colored grinding surface is caused to develop a different color. This coloring process can be implemented by applying a coloring agent to the entire grinding surface which develops a different color, for example, under heat and then abutting a false workpiece composed of a heating element, against the tips of the abrasive grains. Such a method enables a color change to occur only in the coloring agent located on the tips (surfaces) of the abrasive grains 20 actually involved in grinding work. It is thus possible to accurately determine the shape, size, and distribution density of the abrasive grains actually involved in grinding work.

Besides heating, a chemical reaction or the like may be used as a method of causing the coloring agent on the surfaces of the abrasive grains to develop a different color.

Third Embodiment

In the description of the first and second embodiment, an image of the grinding surface of the grindstone 20 is picked up after it has been colored. Then, the conditions of the abrasive grains are inspected on the basis of the image data obtained by this image pickup.

In contrast, a first coloring agent is mixed into the base of the grindstone or the binder, while a second coloring agent is mixed into a material for the abrasive grains. Subsequently, the grindstone is produced using the materials into which the respective coloring agents have been mixed. Such a grindstone eliminates the need to color the grinding surface before inspection. It is thus possible to inspect the condition of the grinding surface promptly and accurately using a simple facility and procedure.

In this example, the first coloring agent is mixed into the base of the grindstone or the binder, while the second coloring agent is mixed into the material for the abrasive grains. However, a coloring agent may be mixed into only one of these materials. FIG. 7 is a partly enlarged view of a grindstone produced by mixing a coloring agent into the binder 13. Such a grindstone produces effects similar to those of the first embodiment.

Further, the color of the coloring agent mixed into the material is selected so that there is a predetermined or larger difference in density between the surface of each abrasive grain and the surface of the base (the area in which the binder is formed) in the image data obtained by the image pickup.

If the method of this embodiment is applied to a porous grindstone, heat or chemical reaction may be utilized to change the color of the surface of each abrasive grain on a porous grindstone produced by mixing a coloring agent into an appropriate material. Alternatively, only the surfaces of the abrasive grains may be colored differently.

Other Embodiments

In the first and second embodiments, the spray 60 is used to spray a coloring agent on the grinding surface in order to color it. However, the present invention is not limited to this aspect. A reservoir may be provided in which a coloring liquid is accommodated. Then, the grinding surface of the grindstone can be colored by being immersed in the coloring liquid in the reservoir. In this case, the abrasive grains may be made water repellent before the grindstone is immersed in the coloring liquid. This eliminates the need to remove a paint adhering to the abrasive grains. Therefore, one step can be omitted.

Further, in the first embodiment, the controller 80 analyzes binarized image data to calculate numerical data indicating the shape and size of the surface of each abrasive grain 20 and the distribution density of the abrasive grains 20. Then, the controller 80 displays or prints out the calculated data as inspection results. However, the binarized image data may be directly displayed or printed out so that the inspector can visually analyze the displayed or outputted image data to determine the condition of the abrasive grains.

Furthermore, in the description of the example in the first embodiment, image data is binarized. However, the present invention is not limited to this aspect. A graphic process may be executed to create image data in which the surface of each abrasive grain is displayed with a color different from that of the other areas. This image data may be displayed or printed out.

Figure 7C:
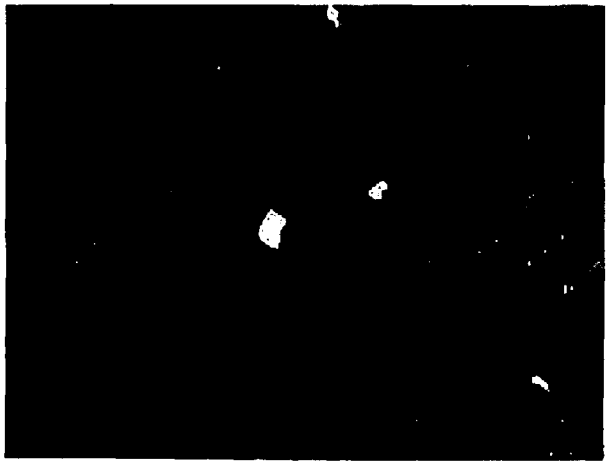

Furthermore, if the image data is digital and is organized so that each pixel is represented by plural bits of digital data, the lowest bit or the lower plural bits of the digital data are deleted. This enables the removal of image components indicating flaws or concaves and convexes on the grinding surface other than the abrasive grains. It is therefore possible to further clarify only the abrasive grains 20, for example, as shown in FIG. 7C.

Moreover, in the description of the example in the first embodiment, the exclusive microscope 70 with the camera is used to pick up an image of the grinding surface of the grindstone 10. However, a general-purpose microscope and a general-purpose digital camera may be used to pick up an image of the grinding surface of the grindstone 10. Then, a USB cable, a memory card, or the like may be used to load the resulting image data in a general-purpose data format into a personal computer for image processing. This provides a very inexpensive inspection system.

Furthermore, the type of grinding tool is not limited to a non-porous grindstone, and may be a porous grindstone. Many variations may be made to the configuration of the inspection system, the inspection procedure and its contents, the type and color of the coloring agent, the shape of the grindstone, the structure of the grinding surface, and others without departing from the spirit of the present invention.

Additional advantages and modifications will readily occur to those skilled in the art. Therefore, the invention in its broader aspects is not limited to the specific details and representative embodiments shown and described herein. Accordingly, various modifications may be made without departing from the spirit or scope of the general inventive concept as defined by the appended claims and their equivalents.

What is claimed is:

1. A grinding tool comprising:

a tool base having a surface set to have a first color; and a plurality of abrasive grains discretely provided on the surface of the tool base and formed so that at least a surface of each abrasive grain is set to have a second color different from the first color, wherein the color of the surfaces of the abrasive grains is set to have a density differing from that of the color of the surface of the base by a predetermined or larger amount.

2. The grinding tool according to claim 1, wherein at least one of the tool base and each of the abrasive grains is coated with a coloring agent so that the surface of the abrasive grains is colored differently from the surface of the tool base.

3. A grinding tool comprising:

a tool base having a surface set to have a first color; and a plurality of abrasive grains discretely provided on the surface of the tool base and formed so that at least a surface of each abrasive grain is set to have a second color different from the first color, wherein at least one of the tool base and each of the abrasive grains is mixed with a coloring additive so that the surface of the abrasive grain is colored differently from the surface of the tool base.

4. The grinding tool according to claim 3, wherein the color of the surfaces of the abrasive grains is set to have a density differing from that of the color of the surface of the base by a predetermined or larger amount.

5. An inspection method for inspecting conditions of a grinding surface of a grinding tool, the grinding surface comprising a surface of a tool base on which a large number of abrasive grains are discretely formed, the inspection method comprising:

a step of setting a color difference between the surface of the tool base and a surface of each of the abrasive grains on the grinding surface;

a step of picking up an image of the grinding surface for which the color difference has been set, to obtain image data;

a step of subjecting the image data obtained to image processing on the basis of the color difference so as to emphasize a difference between data indicating the surface of the abrasive grains and data indicating the surface of the tool base, both data being contained in the image data; and a step of outputting the image data that has been subjected to the image processing.

6. The inspection method according to claim 5, wherein the step of subjecting the image data to the image processing comprises:

a step of detecting a density distribution of the image data obtained;

a step of setting a binarization threshold on the basis of the detected density distribution; and a step of binarizing the obtained image data on the basis of the set binarization threshold.

7. The inspection method according to claim 5, wherein the step of subjecting the image data to the image processing comprises:

a step of converting the image data on the grinding surface into digital data; and a step of deleting lower predetermined bits from the digital image data obtained by the conversion.

8. The inspection method according to claim 5, further comprising:

a step of calculating numerical data indicating at least one of the distribution density of the abrasive grains and the shape and size of each of the abrasive grains on the basis of the image data that has been subjected to the image processing.

9. The inspection method according to claim 5, further comprising:

a step of comparing the calculated numerical data with thresholds preset to determine quality of the grinding surface; and a step of outputting a result of the comparison.

10. The inspection method according to claim 5, wherein the step of setting the color difference comprises:

a step of applying a coloring agent to the grinding surface, the coloring agent having a color different from that of the surface of each abrasive grain; and a step of removing only those portions of the coloring agent applied to the grinding surface which are located on the surfaces of the abrasive grains, to expose the surfaces of the abrasive grains.

11. The inspection method according to claim 10, wherein the step of removing the coloring agent only from the surfaces of the abrasive grains comprises abutting the grinding surface to which the coloring agent has been applied, against a false workpiece for grinding work to remove the coloring agent only from the surfaces of the abrasive grains actually involved in the grinding work.

12. The inspection method according to claim 5, wherein the step of setting the color difference comprises:

a step of applying a coloring agent of a first color to the grinding surface; and a step of changing a color developed by those portions of the coloring agent applied to the grinding surface which are located on the surfaces of the abrasive grains, to a second color.

13. An inspection apparatus for inspection conditions of a grinding surface of a grinding tool, the grinding surface comprising a surface of a tool base on which a large number of abrasive grains are discretely formed, the inspection apparatus comprising:

means for setting a color difference between the surface of the tool base and a surface of each of the abrasive grains on the grinding surface;

a camera which picks up an image of the grinding surface for which the color difference has been set, to output image data obtained;

means for subjecting the image data outputted by the camera on the basis of the color difference so as to emphasize a difference between data indicating the surface of the abrasive grain and data indicating the surface of the tool base, both data being contained in the image data; and means for outputting the image data that has been subjected to the image processing.

14. The inspection apparatus according to claim 13, wherein the means for subjecting the image data to the image processing comprises:

means for storing the image data outputted by the camera;

means for detecting a density distribution of the stored image data;

means for setting a binarization threshold on the basis of the detected density distribution; and means for binarizing the stored image data on the basis of the set binarization threshold.

15. The inspection apparatus according to claim 13, wherein the means for subjecting the image data to the image processing comprises:

means for converting the image data on the grinding surface into digital data; and means for deleting lower predetermined bits from the digital image data obtained by the conversion.

16. The inspection apparatus according to claim 13, further comprising:

means for calculating numerical data indicating at least one of the distribution density of the abrasive grains and the shape and size of each of the abrasive grains on the basis of the image data that has been subjected to the image processing.

17. The inspection apparatus according to claim 16, further comprising:

means for comparing the calculated numerical data with thresholds preset to determine quality of the grinding surface; and means for outputting a result of the comparison.

18. The inspection method according to claim 13, wherein the means for setting the color difference comprises:

means for applying a coloring agent to the grinding surface, the coloring agent having a color different from that of the surface of each abrasive grains; and means for removing only those portions of the coloring agent applied to the grinding surface which are located on the surfaces of the abrasive grains, to expose the surfaces of the abrasive grains.

19. The inspection apparatus according to claim 13, wherein the means for removing the coloring agent only from the surfaces of the abrasive grains comprises abutting the grinding surface to which the coloring agent has been applied, against a false workpiece for grinding work to remove the coloring agent only from the surfaces of the abrasive grains actually involved in the grinding work.

20. The inspection apparatus according to claim 13, wherein the means for setting the color difference comprises:

means for applying a coloring agent of a first color to the grinding surface; and means for changing a color developed by those portions of the coloring agent applied to the grinding surface which are located on the surfaces of the abrasive grains, to a second color.

* * * * *